United States Patent [19]

Wysocki

[11] 4,261,462

[45] Apr. 14, 1981

[54] DISPLAY PACKAGE

[75] Inventor: Lawrence S. Wysocki, Chicago, Ill.

[73] Assignee: Champion International Corporation, Stamford, Conn.

[21] Appl. No.: 140,163

[22] Filed: Apr. 14, 1980

Related U.S. Application Data

[63] Continuation of Ser. No. 17,602, Mar. 5, 1979, abandoned.

[51] Int. Cl.[3] ..... B65D 73/00

[52] U.S. Cl. ..... 206/45.31; 206/459; 206/462; 206/216

[58] Field of Search ..... 206/462, 45.31, 45.34, 206/459, 63.3, 45.12, 216

[56] References Cited

U.S. PATENT DOCUMENTS

| | | | |
|---|---|---|---|
| 2,306,078 | 12/1942 | Nydegger | 206/45.31 |
| 3,369,660 | 2/1968 | Hartman | 206/462 |
| 3,375,921 | 4/1968 | Ligon | 206/462 |
| 3,587,848 | 6/1971 | Froehlig | 206/462 |
| 3,695,417 | 10/1972 | Stoker Jr. | 206/462 |
| 3,698,551 | 10/1972 | Tomlinson | 206/459 |
| 3,869,044 | 3/1975 | Olsson et al. | 206/63.3 |
| 4,105,116 | 8/1978 | Jones et al. | 206/459 |

*Primary Examiner*—Joseph Man-Fu Moy
*Attorney, Agent, or Firm*—Evelyn M. Sommer

[57] ABSTRACT

A display package for an article including a front support sheet having an opening; a rear support sheet coupled to the front sheet; a flexible sheet having a portion extending from the front sheet, spanning the opening and receiving the article; and a third support sheet received inside and adjacent the flexible sheet. The third support sheet is advantageously formed from the material cut from the first sheet to form the opening. The third sheet not only adds additional support for the flexible sheet and the article but also provides additional space on the package for printed matter.

8 Claims, 14 Drawing Figures

DISPLAY PACKAGE

This is a continuation of application Ser. No. 17,602, filed Mar. 5, 1979, now abandoned.

This invention relates to a display package for articles, and more particularly relates to such a package having a transparent flexible sheet in which the article is received, which flexible sheet is supported by at least one support sheet.

Numerous prior art devices have been contrived for supporting an article for display, such as in a retail store. These devices are usually comprised of two support sheets of cardboard material and a flexible, transparent sheet coupled between the support sheets. The article is supported between the inside of the flexible sheet and the support sheets. In many of these prior art devices, an opening is cut in at least a portion of one support sheet to provide an area into which a portion of the flexible transparent sheet can be secured.

An example of this is shown in U.S. Pat. No. 3,185,295, issued on May 25, 1965 to Crane, and entitled Combination Three-Dimensional Article And Closed Display Package Therefor. As specifically disclosed in that patent a support sheet has an opening formed therein by cutting material from the center of the support sheet. Such material cut from the support sheet is discarded, and a sheet of flexible, transparent material is placed across the opening. The article to be displayed is placed adjacent the flexible sheet and the support sheet and flexible sheet are folded so that the article is enclosed on each side by the flexible sheet. Suitable means are provided for maintaining the two folded portions of the support sheet in a contacting relationship.

Unfortunately, there are certain deficiencies exhibited by such a display package. First, the material cut from the support sheet to form the opening is discarded as scrap and is thereby wasted. Also, the flexible sheet covering the article tends to loosen or weaken with repeated handling of the package after manufacture, especially during transport and during display. In addition, the article supported by such a display package, if the flexible sheet is transparent, is exposed to potentially harmful light rays from fluorscent lights or the sun. Finally, such a display package has a limited area for the printing of graphic or line information, such as advertising or instructions for use of the article.

Accordingly, it is an object of the present invention to provide an improved display package which can be formed with a minimum of material waste.

Another object of the present invention is to provide a display package having a flexible sheet which is reinforced by material usually discarded to provide added strength and support to the overall package.

Another object is to provide a display package having a flexible, transparent cover which receives therein a sheet of somewhat stiffer material upon which extra promotional or instructional printing may be provided.

Another object of the present invention is to provide a display package which utilizes a flexible, transparent cover for an article with an additional sheet of material interposed inside to protect the article from harmful light radiation.

The foregoing objects are basically attained by providing a display package comprising a first support sheet; a second support sheet coupled to the first support sheet; means defining an opening in at least the first support sheet; a flexible sheet having a portion extending from the first support sheet, spanning the opening and receiving the article; and a third support sheet located adjacent the flexible sheet.

More specifically, the third support sheet is formed from the material cut from the first support sheet to form the opening and has an outline configuration substantially the same as the configuration of the opening. The first and second sheets can be separate or can be integrally formed and folded into contacting relationship. The third support sheet can be interposed between the flexible sheet and the article such that the third sheet is substantially planar, or the third sheet can have a U-shaped cross section or an L-shaped cross section, in which case a portion of the third sheet lies between the bottom of the article and the flexible sheet. The third sheet can have a window formed therein so that a portion of the article can be visible therethrough. Similarly, a window can be formed in the second support sheet so that the rear of the article can be visible therethrough.

Other objects, advantages and salient features of the present invention will become apparent from the following detailed description, which, taken in conjunction with the annexed drawings, discloses preferred embodiments of the present invention.

Referring now to the drawings which form a part of this original disclosure and which are not necessarily to scale:

Figure 1:
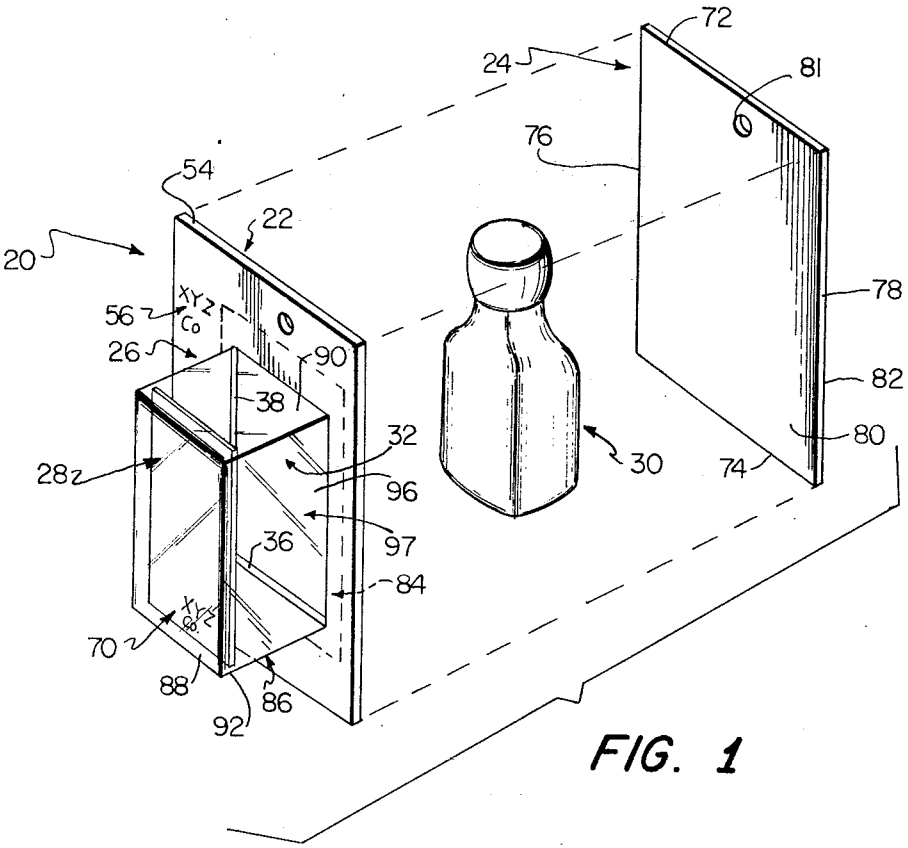
FIG. 1 is a right, exploded perspective view of the display package in accordance with the present invention showing the various parts of the package including the flexible sheet and the three support sheets in a position just before the article is enclosed therein.

Referring now to the drawings in more detail, as seen in FIG. 1 the display package 20 of the present invention comprises a first or front support sheet 22, a second or rear support sheet 24, a flexible, transparent sheet 26, and a third support sheet 28, for displaying and packaging the article 30. This article can be a small figurine or other image, or can be a small container or bottle such as is used for cosmetic preparations and the like. In all events, the packaged article can have numerous different shapes or configurations.

The first and second sheets, as well as the third sheet, are preferably formed from stiff cardboard and the flexible sheet 26 is advantageously formed from a thin, transparent plastic membranous sheet of a vinyl composition, such as polyvinyl chloride. As such, the flexible sheet can be stretched, such as by a vacuum forming apparatus, and can also be subsequently reduced, such as by shrinking, by the application of heat, such as through the use of a heated stream of air.

Figure 2:
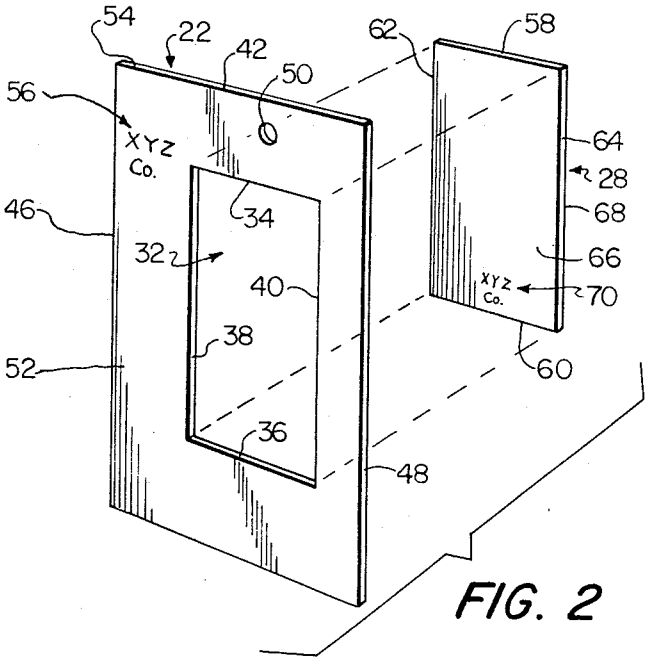
FIG. 2 is a right perspective view illustrating how the third support sheet is formed as the material cut from the first support sheet to define the opening therein.

As seen in FIG. 2, the first support sheet 22 is rectangular and has an opening 32 defined therein, somewhat offset from the center line of the sheet. This opening 32 is formed by cutting the sheet 22 and is shown in FIG. 2 as being rectangular. If desired, both the sheet 22 and the opening 32 can have a different configuration, such as square, circular, triangular or the like. The opening 32 has a top edge 34, a bottom edge 36, a left side edge 38 and a right side edge 40.

The first support sheet 22 has a top edge 42, a bottom edge 44, a left side edge 46 and a right side edge 48. An aperture 50 is located between the top edge 34 of the opening and the top edge 42 of the first sheet so that a support rod can be manipulated therethrough to support the display package 20. The first support sheet has a front side 52 and a rear side 54.

As seen in FIGS. 1 and 2, the front side 52 of the first support sheet has printing 56 thereon which could also be graphic illustrations. In all events, the front side 52 can have graphic or lined copy substantially covering the entire face.

As seen in FIGS. 1 and 2, the third support sheet 28 has a top edge 58, a bottom edge 60, a left side edge and a right side edge 64. The third support sheet has a front side 66 and a rear side 68 with printing 70 being located on the front side 66 of the third sheet. The printing can be located on the front side in a position to substantially cover the front side and, in addition to printing, there can be graphic illustrations thereon.

As is evident from FIG. 2, the material forming the third sheet 28 is that which has been cut from the first sheet 22 to form the opening 32. Thus, the outline configuration of the third sheet 28 is the same as the configuration of the opening 32. In other words, the top edge 34 of the opening 32 corresponds to the top edge 58 of the third sheet. A similar correspondence between the bottom edge and the two side edges of the opening 32 and the third sheet 28 is also present.

Referring again to FIG. 1, the second or rear support sheet 24 has a top edge 72, a bottom edge 74, a left side edge 76 and a right side edge 78. This rear sheet 24 is shown as having a rectangular outer configuration, which is the same as the outer configuration of sheet 22. The second support sheet has a front side 80 and a rear side 82 with an aperture 81 located below top edge 72 of the second sheet 24 in line with aperture 50 in the first support sheet 22 for reception of a support rod.

Referring again to FIG. 1, the flexible sheet 26 is shown therein having an outwardly protruding receiving portion 86 extending from the first support sheet 22 and a support portion 84 lying against the rear side 54 of the first sheet 22. Once the display package is completely formed, the support portion 84 will lie between the first and second sheets. The receiving portion 86 is shown as having a front wall 88, a top wall 90, a bottom wall 92, a left side wall 94 and a right side wall 96, thereby defining a pocket 97 therein. The receiving portion 86 spans the opening 32 and receives the article 30, as well as the third support sheet, 28 therein.

One preferable manner in which the flexible sheet is formed as shown in FIG. 1 is to place the sheet in a flat configuration over the opening 32 such that the support portion 84 lies on top of the rear side 54 of sheet 22 and to adhere the support portion 84 thereto. Then, the receiving portion 86 is laterally offset away from the first sheet, thereby forming the pocket 97 therein. This can readily and conveniently be provided by any suitable means for stretching the flexible sheet, as for example, vacuum forming apparatus. Although the receiving portion 86 shown in FIG. 1 has clearly delineated somewhat rectangular walls, the vacuum forming apparatus can be such that the flexible sheet can have a curved outer surface and be somewhat cup-like when vacuum formed. In all events, once the pocket 97 is formed, the third support sheet 28 is placed inside the pocket against the front wall 88 of the receiving portion. Since the flexible sheet is preferably transparent the printing designated 70 on the third sheet 28 is visible through the transparent flexible sheet 26.

After the third support sheet 28 is in place adjacent the flexible sheet, the article 30 is placed inside the pocket 97 against the third sheet and the second sheet 24 is moved towards the rear side 54 of the front or first sheet 22. Then, the first and second sheets are secured together. This can be done by adhesive 98 interposed between the first and second sheets outside the outer periphery of the support portion 84 of the flexible sheet. This is clearly shown in FIGS. 4 and 5. Alternatively, the first and second sheets can be adhered together by adhesive on both sides of the support portion 84 of the flexible sheet.

After the article 30 is enclosed as described above, the pocket may be reduced in size by reducing the receiving portion 86 to substantially conform to the combination of the article 30 and the third supporting sheet 28. This may be done by shrinking the flexible sheet which is formed, as set forth above, preferably of a material which can be reduced by the application of heat, such as through the use of a heated stream of air. After such heat is applied, the flexible sheet will conform to the contours and protuberant portions of the combination of the article 30 and the third support sheet 28. Thus, the third sheet 28 shown in FIG. 4 will be substantially planar, although the side edges 62 and 64, as well as the top and bottom edges 58 and 60 will be curved slightly inwardly. In addition, although not shown because of reasons of clarity, there may be a slight bending of the rear or second sheet 24 after the flexible sheet is reduced.

Figure 3:
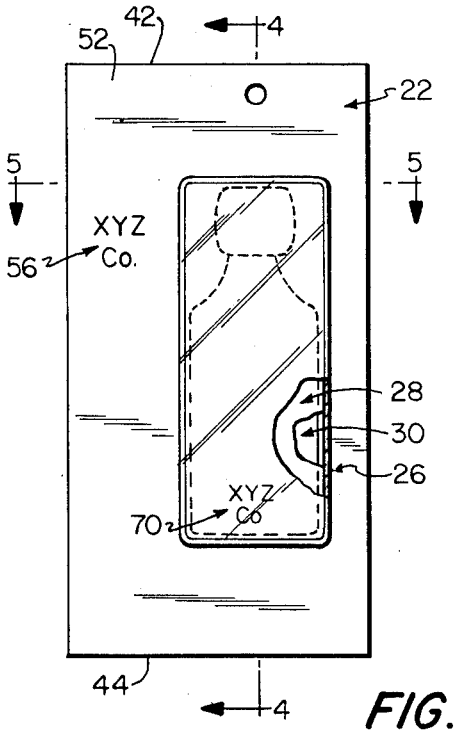
FIG. 3 is a front elevational view of the assembled display package in accordance with the present invention.
Figure 4:
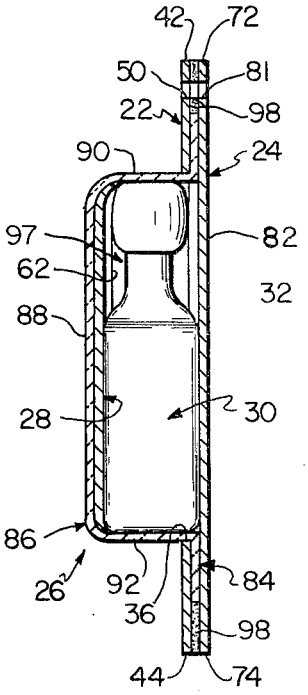
FIG. 4 is a right-side elevational view in section taken along lines 4—4 in FIG. 3 illustrating a third support sheet in substantially planar form.
Figure 5:
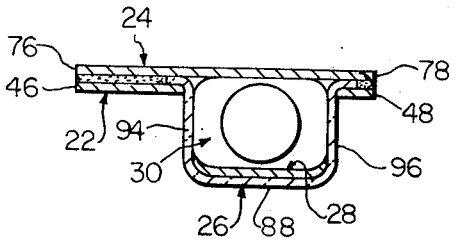
FIG. 5 is a top plan sectional view taken along lines 5—5 in FIG. 3.

Referring to FIGS. 3, 4 and 5, the fully and completely formed package 20 is shown wherein the third support sheet 28 adds reinforcement and support to the flexible sheet 26. In addition, the printed material 70 on the third support sheet 28 is visible through the transparent flexible sheet 26.

As best seen in FIG. 4, the article 30 is securely received inside the pocket 97 and has its front portion contacting the third support sheet 28 and its rear portion contacting the front side 80 of the second support sheet 24. A portion of the article 30 is located inside the opening 32. As seen therein, the third support sheet is interposed between the front part of the article and the front wall 88 of the flexible sheet 26. If desired, the entire extent of the third support sheet 28 need not be used, and it can accordingly be cut so that only a portion thereof is used to support the flexible sheet 26.

Figure 6:
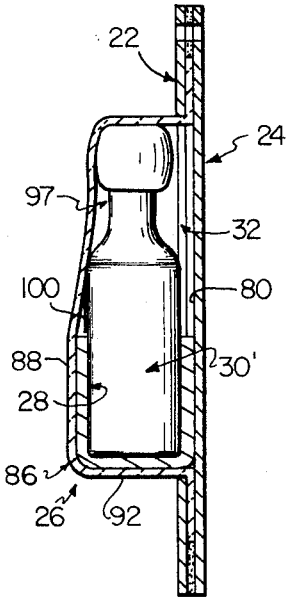
FIG. 6 is a right-side elevational view in section similar to FIG. 4 but showing the third support sheet having a U-shaped cross section and an article having a front label.

Referring now to FIG. 6, the third sheet 28 is folded twice, has a U-shaped cross section and is oriented so that a portion thereof lies between the front wall 88 of the flexible sheet and the bottom part of the front of the article 30', another portion lies between the bottom of the article 30' and the bottom wall 92 of the receiving portion 86 and the final portion lies between the bottom part of the rear of the article 30' and the front side 80 of the second support sheet 24. In this type of configuration, a front article label 100 is visible through the transparent flexible sheet 26 above the top of the third sheet 28.

Figure 7:
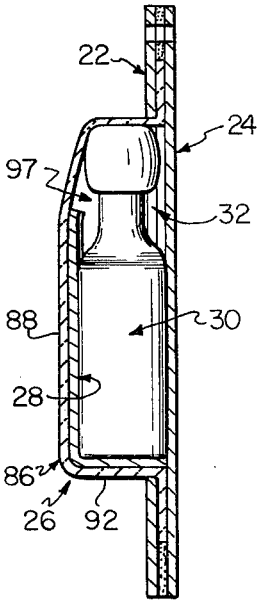
FIG. 7 is a right-side elevational view in section similar to that shown in FIG. 4, but showing the third support sheet having an L-shaped cross section.

Referring now to FIG. 7, the third support sheet 28 is folded once and is shown in an L-shaped configuration in which a portion lies between the front wall 88 of the receiving portion of the flexible sheet 26 and article 30 and another portion lies between the bottom of the article 30 and the bottom wall 92 of the receiving portion.

In the embodiments shown in both FIGS. 6 and 7, at least a part of the third support sheet 28 is located in the opening 32.

Figure 10:
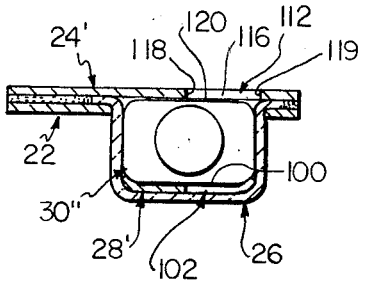
FIG. 10 is a top plan view in section taken along lines 10—10 in FIG. 8.
Figure 8:
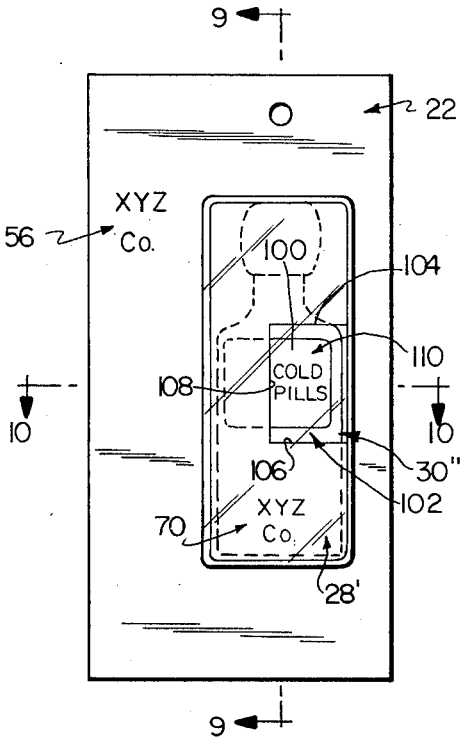
FIG. 8 is a front elevational view of a display package similar to that shown in FIG. 3, except the third support sheet has a window therein.
Figure 9:
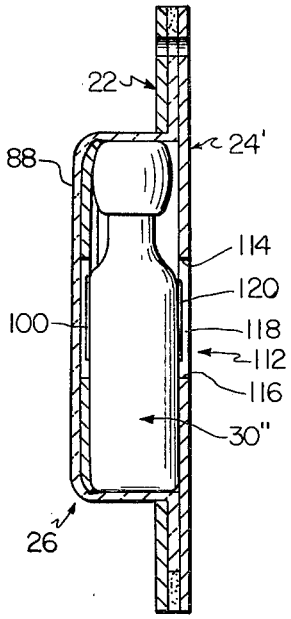
FIG. 9 is a right-side elevational view in section taken along lines 9—9 in FIG. 8 showing an article having both front and rear labels and the third support sheet having a window and the second sheet also having a window.

Referring now to FIGS. 8, 9 and 10, the display package shown therein is slightly modified insofar as the third support sheet and the second support sheet are concerned. Specifically, the third support sheet 28' has a window 102 formed as a slot in the side in substantially the middle thereof. This window 102 has a top edge 104, a bottom edge 106 and a side edge 108, all of which are straight so that the window is in substantially rectangular form.

The rear or second support sheet 24' has a rectangular window 112 formed therein so as to substantially coordinate with window 102 in the third support sheet 28'. That is, it is of substantially the same outline dimensions and is located opposite the third sheet window once the package is assembled. This window is rectangular and has a top edge 114, a bottom edge 116, a left side edge 118 and a right side edge 119.

The article 30'' shown in FIGS. 8, 9 and 10 has, in addition to the front label 100, a rear label 120. As seen in FIG. 8, printing designated as 110 on the front label 100 is visible through window 102 in the third sheet 28' and any printing on the rear label 120 is visible through window 112 in the second sheet 24'.

Referring now to FIGS. 11–14, a modified embodiment of the present invention is shown in which the package 129 has first and second support sheets integrally formed in a single blank 130. This blank 130 is to be folded along fold line 132 to define a front support sheet 134 and a rear support sheet 136. The support sheet 138 is formed from blank 130 by cutting the opening 140 therein. Thus, the outline configuration of support sheet 138 is the same as the configuration of opening 140.

Figure 11:
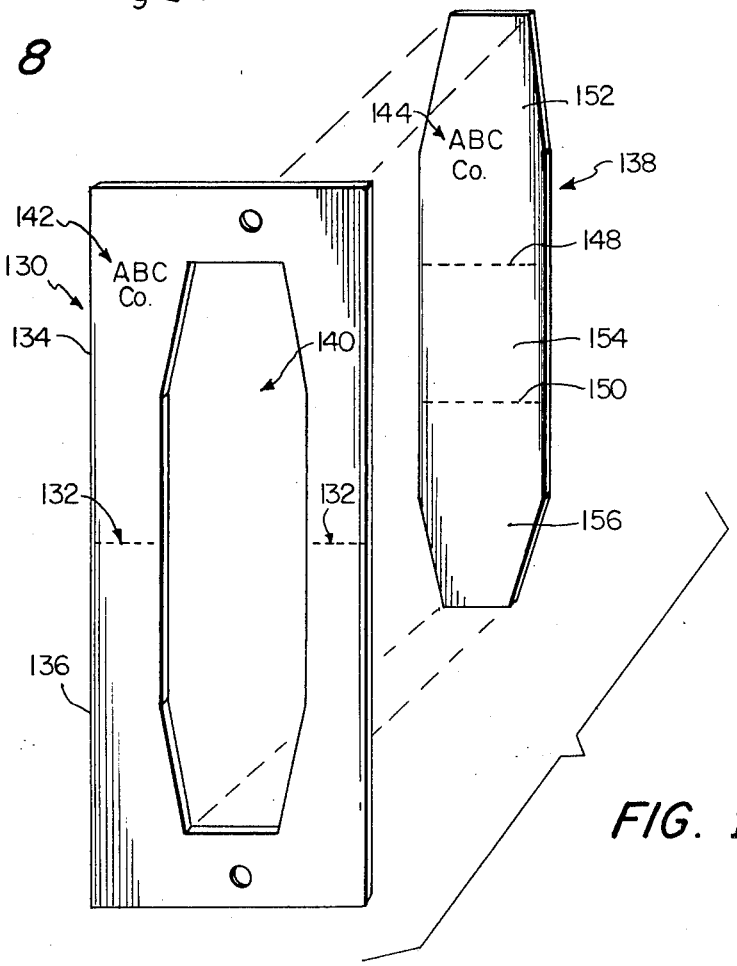
FIG. 11 is a right perspective view of a modified support sheet blank in which the front and rear sheets are integrally formed and in which the third support sheet is also formed from the material cut from the main support sheet to form the opening therein.

As seen in FIG. 11, printed material 142 is located on the front face of the front sheet 134 and additional printed material 144 is located on the front face of the support sheet 138. As set forth above, although the printed material shown covers only a portion of these faces, it is readily apparent that the entire surfaces can be covered with any graphical or printed material.

Figure 14:
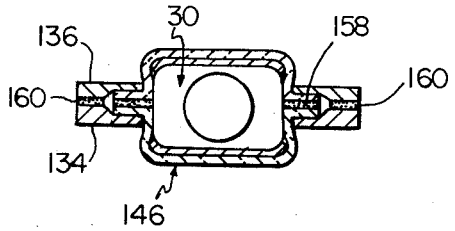
FIG. 14 is a top plan view in section taken along lines 14—14 in FIG. 12.
Figure 12:
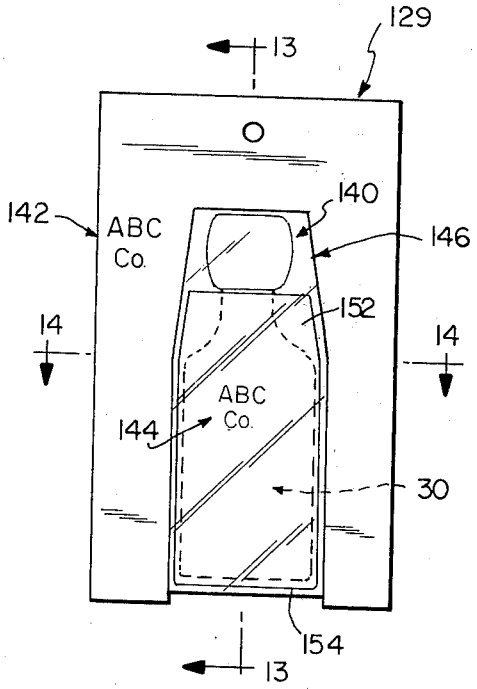
FIG. 12 is a front elevational view of the assembled display package formed from the modified support sheets shown in FIG. 11.
Figure 13:
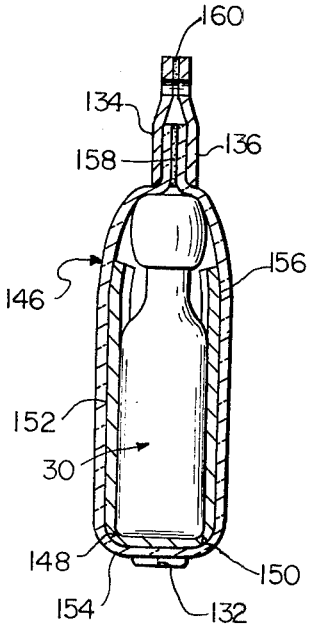
FIG. 13 is a right-side elevational view in section taken along lines 13—13 in FIG. 12.

The modified display package 129 shown in FIGS. 11–14, also includes a flexible, transparent sheet 146 similar to that described above regarding FIGS. 1–5. This flexible sheet 146 is coupled to the rear face of blank 130 and is expanded into a pocket defining configuration for receiving the support sheet 138 as well as the article 30. In this embodiment, the flexible sheet 146 is itself folded when blank 130 is folded, so that the support sheet 138 and the article 30 are completely received therein. The support sheet 138 is folded twice along fold lines 148 and 150 to define, as seen in FIGS. 11 and 13, a front portion 152, a bottom portion 154 and a rear portion 156. As best seen in FIGS. 12, 13 and 14, the support sheet 138 is substantially U-shaped in cross section and is interposed between the article 30 and the inner surface of the folded flexible sheet 146, once the package is fully assembled.

Preferably, the outer peripheries of the folded parts of the flexible sheet 146 are adhered together by adhesive 158, seen in FIGS. 13 and 14 and similarly the outer peripheries of the front sheet 134 and the rear sheet 136 can also be adhered together by adhesive 160, seen most clearly in FIG. 14. Of course, various other methods, such as stapling, can be utilized to secure the flexible sheet 146 to the blank 130 and also to secure the front sheet 134 and the rear sheet 136.

In all events, the display package is completely assembled as described above and results in a package in which the support sheet 138 reinforces the flexible sheet 146, provides a light screen for the article and provides additional space for printed matter visible through the transparent flexible sheet 146. As seen in FIGS. 12 and 13, the article 30 is located in the opening 140 and the flexible sheet 146 spans that opening, extends from the blank 130 and receives the article 30 therein.

While advantageous embodiments have been chosen to illustrate the invention, it will be understood by those skilled in the art that various changes and modifications can be made therein without departing from the scope of the invention as defined in the appended claims.

What is claimed is:

1. A display package for an article, the combination comprising:

a first support sheet, formed from a paperboard material and having a front and rear surface, said first support sheet including a die cut aperture therein, said die cut aperture having dimensions substantially corresponding to the dimensions of said article;

a transparent blister enclosure bonded to the rear surface of said first support sheet and extending through said die cut aperture therein, said blister enclosure for receiving said article;

a second support sheet having dimensions at least as large as said die cut aperture of said first support sheet, said second support sheet being bonded to the rear surface of said first support sheet and forming a wall of said blister enclosure thereby sealing said blister enclosure; and a third support sheet formed of paperboard material and disposed within said blister enclosure, said support sheet being interposed between said blister enclosure and said article, said third support sheet operative to maintain the structural integrity of said blister enclosure and providing an area for the printing of indicia, and wherein said third support sheet is formed from the die cut portion of said first support sheet whereby the amount of paperboard necessary to form said display package is minimized.

2. A package according to claim 1, wherein said first and second support sheets have substantially the same outline configuration.

3. A package according to claim 1, wherein said first and second support sheets are integrally formed.

4. A package according to claim 1, wherein said first and second support sheets are integrally formed and are folded into a contacting relationship.

5. A package according to claim 1, wherein said third support sheet has a substantially L-shaped cross section.

6. A package according to claim 1, wherein said third support sheet has a substantially U-shaped cross section.

7. A package according to claim 1, wherein said third support sheet has a slot formed therein adjacent said transparent blister enclosure so that at least a portion of the article is visible therethrough.

8. A package according to claim 1 wherein said second support sheet has a window formed therein through which at least a portion of the article is visible.

* * * * *